United States Patent [19]

Morefield

[11] 4,201,236

[45] May 6, 1980

[54] HAIR TREATMENT DEVICE

[76] Inventor: Joe Morefield, 400 Reynolds St., Springhill, La. 71075

[21] Appl. No.: 927,149

[22] Filed: Jul. 24, 1978

[51] Int. Cl.[2] ..... A45D 2/00

[52] U.S. Cl. ..... 132/40

[58] Field of Search ..... 132/40, 42, 38, 122, 132/11 R, 44, 46, 33, 101

[56] References Cited

U.S. PATENT DOCUMENTS

| | | | |
|---|---|---|---|
| 1,236,871 | 8/1917 | Richards | 132/44 |
| 2,323,254 | 6/1943 | Sterling | 132/33 G |
| 2,429,176 | 10/1947 | Watson | 132/40 |
| 3,040,753 | 6/1962 | Russell | 132/40 |
| 3,084,699 | 4/1963 | Gedid | 132/46 |
| 3,358,698 | 12/1967 | Blanchard | 132/40 |
| 3,682,182 | 8/1972 | Small | 132/40 |

*Primary Examiner*—G. E. McNeill

[57] ABSTRACT

A hair treatment device characterized by a generally cylindrically shaped, hollow tension roller having a plurality of apertures in the wall thereof, and a securing means cooperating with the tension roller for securing the tension roller and strands of hair wound on the tension roller; the tension roller and hair strands rolled thereon are subjected to a selected degree of tension for the purpose of removing curl in the hair strands and setting the hair.

7 Claims, 13 Drawing Figures

HAIR TREATMENT DEVICE

BACKGROUND OF THE INVENTION

1. Field of the Invention

This invention relates to hair treatment, and more particularly, to a hair treatment device for use primarily in the process of setting hair and straightening naturally curly hair by applying tension to the hair shaft and applying a selected hair setting or relaxing solution. One of the problems associated with curly hair is the tendency of the hair ends to become "stringy" and difficult to manage. The hair shafts are subjected to tension in the curls and can be relaxed only by application of certain chemicals to eliminate or at least minimize the wave pattern in the hair. Typically, these chemicals are applied after the hair is parted, and the solution is allowed to remain on the hair for a specified period of time to relax the hair shafts and remove the wave. This technique has long been used to relax the natural wave in hair and to change the wave pattern to more manageable proportions. The hair treatment device of this invention includes a tension roller of generally cylindrical configuration, which in a preferred embodiment is split along the length thereof and contains a plurality of apertures, the tension roller being designed to roll strands of hair thereon and to subject the strands so positioned to a selected amount of tension. The tension roller is secured in the hair with the aid of a comb base, a pin base or a roller base having a design hereinafter described to help facilitate tensioning of the hair shafts and to help effect the desired straightening of the hair. The tension roller of this invention may be quickly and easily positioned in the hair, and hair relaxing solutions of desired composition may then be applied in order to accomplish the desired purpose. The tension roller can also be used to "set" hair and create curly hair in permanent waves by using the comb base, pin base or roller base in cooperation with a tension roller which is not split according to a preferred embodiment of this invention.

2. Description of the Prior Art

Many devices for curling and treating hair are known in the prior art, and typical of such devices is the hair curling device disclosed in U.S. Pat. No. 3,105,503 to Albert Safianoff, which consists of a mandrel and a cooperating sleeve designed to hold a tress of hair in wound configuration on the mandrel. The device is designed to form curls in the hair as the individually wound tresses are caused to assume a curled configuration from winding on the mandrel. Another hair curling device is disclosed in U.S. Pat. No. 2,423,252 to O. R. Nemeth, which device is used for both dressing and drying hair. The Nemeth aparatus includes a hollow cylindrical body fitted with a spaced disc and holes provided in the body to permit air to be blown through the hollow interior of the body and out of the holes. Hair tresses are wound around the cylindrical body between the discs, treated as desired, and dried by application of air, for example, by means of a hair dryer. The tresses are then secured in place by elastic bands stretched from one end of the device to the other.

While the references described above are used primarily to render hair curly by the techniques described therein, the device of the instant invention is designed both to curl hair and to straighten naturally curly hair by applying tension to the hair shafts and subsequently applying a hair setting or relaxing solution of selected concentration to the hair. There exists today a need in the hair treatment field for, and it is an object of this invention to provide, a hair treatment device for both setting hair and straightening naturally curly hair, which device is small, light in weight, easy to manipulate and to anchor in the hair, and is capable of receiving strands, tufts or tresses of hair in isolated fashion for efficient treatment.

Another object of this invention is to provide a hair treatment device which applies tension to the hair shaft preparatory to application of a hair setting or relaxing solution, and eliminates the necessity for combing and smoothing the hair in isolated segments or sections prior to application of the hair treatment solution.

A still further object of this invention is to provide a new and improved hair treatment device which in a preferred embodiment is characterized by a generally cylindrically shaped, split tension roller which may be optionally fitted with a tension-applying device such as a spring in the interior thereof, and a securing means for securing the tension roller and hair tuft or tress wound thereon in the hair and applying tension to the hair shaft preparatory to application of a hair relaxing solution to create a smooth, wavy hair shaft which is easily managed.

Yet another object of this invention is to provide a hair treatment device which minimizes contact between the hair treatment solution and the scalp and which includes a generally cylindrically shaped tension roller having a plurality of apertures in the wall thereof, and a comb base having comb teeth for insertion under the tension roller and a tension cord in cooperation with the apertures in the tension roller to maintain a selected amount of tension on the hair strand as the hair is wound on the roller.

Still another object of this invention is to provide a new and improved hair treatment device which includes a generally cylindrically shaped, hollow tension roller having a split side and capable of receiving a tuft or tress of hair wound thereon, with a selected amount of tension applied to the hair by means of the tension in the roller, and further including a roller base and tension cord combination for engagement with the tension roller to maintain the proper tension on the hair shaft and to stabilize the tension roller in the hair.

A still further object of this invention is to provide a cylindrical, hollow tension roller, which in a preferred embodiment is split along the length thereof, and having a plurality of apertures therein and designed to accommodate a securing means including a comb base with comb teeth and comb picks, or a roller base having a pair of roller base legs, the selected securing means being equipped with a tension cord for mating with at least one of the apertures in the tension roller to provide a selected degree of tension on the shaft of the hair wound on the tension roller.

SUMMARY OF THE INVENTION

These and other objects of the invention are provided in a hair treatment device which includes a generally cylindrically shaped tension roller having apertures in the wall thereof in a selected pattern, which roller in a preferred embodiment is split and normally exists with a space between the split edges thereof, and a cooperating securing means which includes either a comb base or a roller base, each of which is fitted with projections for supporting the tension roller, and a tension cord which is attached to the securing means and is fitted to one of the apertures in the tension roller when a strand or tuft of hair is wound thereon in order to subject the hair strand to a selected degree of tension in the treating process.

BRIEF DESCRIPTION OF THE DRAWING

The invention will be better understood by reference to the accompanying drawing, wherein.

DESCRIPTION OF THE PREFERRED EMBODIMENTS

Figure 1:
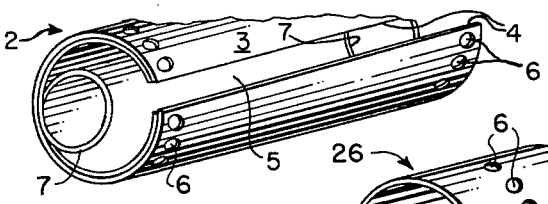
FIG. 1 of the drawing is a perspective view of a preferred embodiment of the tension roller used in the hair treatment device of this invention.
Figure 10:
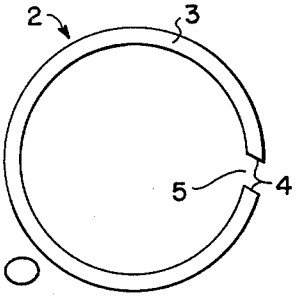
FIG. 10 is a side elevation of the tension roller illustrated in FIG. 2 in relaxed configuration.
Figure 11:
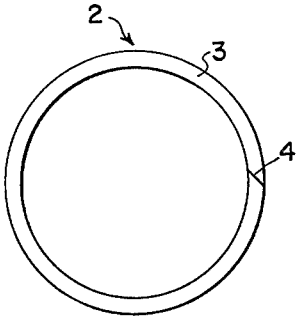
FIG. 11 is a side elevation of the tension roller illustrated in FIG. 2 subjected to tension applied when hair is wound thereon.

Referring now to FIGS. 1, 10 and 11 of the drawing, it will be appreciated that in a preferred embodiment of the invention, a split tension roller 2 is provided, which split is positioned on one side of body 3 in such a manner as to create beveled edges 4, as more particularly illustrated in FIGS. 10 and 11. When no tension is applied to tension roller 2, a space 5 exists between beveled edges 4 as illustrated in FIGS. 1 and 10. Body 3 of tension roller 2 is formed of a material such as plastic, which is resilient and will deform without failure to a configuration as illustrated in FIG. 11. Body 3 is provided with apertures 6 which are included in successive relationship near the outer edges of body 3, as illustrated. Optional tension member 7, in the form of a spring or similar biasing member, may be provided in the hollow interior of tension roller 2 in order to impart tension to body 3 as illustrated in FIG. 1 and as hereinafter described.

Figure 2:
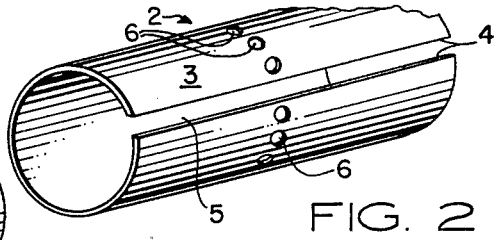
FIG. 2 is a perspective view of another preferred tension roller used in the hair treatment device of this invention.

Referring now to FIG. 2 of the drawing, another preferred embodiment of tension roller 2 is illustrated without provision of a tension member 7 in the hollow interior, and with the provision of apertures 6 in the center section thereof, as illustrated. It will be appreciated by those skilled in the art that a selection of the materials of construction for tension roller 2 will dictate whether or not a tension member 7 is necessary in the interior of tension roller 2 to supply the necessary amount of circumferential bias to body 3. For example, certain plastics, the composition of which is well known to those skilled in the art, may be used in the construction of the tension roller 2 illustrated in FIG. 2 of the drawing in order to provide a selected degree of bias or tension in body 3, and to maintain a space 5 of desired width between beveled edges 4 of body 3 until a desired amount of pressure is applied on tension roller 2 when hair is wound thereon.

Figure 3:
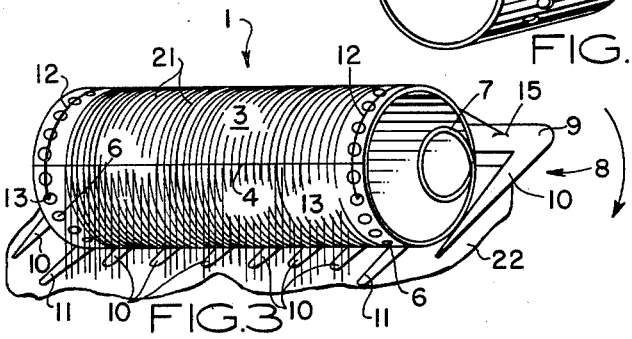
FIG. 3 of the drawing is a front perspective view of the tension roller illustrated in FIG. 1 in a combination with a cooperating comb base.

Referring now to FIGS. 3, 4, 5, and 9 of the drawing, in a preferred embodiment of the invention, it will be appreciated that a strand or tuft of hair 21 is wound on either the tension roller 2 which is illustrated in FIG. 1, or that shown in FIG. 2 in the direction indicated by the arrow. This action creates tension in each hair shaft of hair 21 as body 3 of tension roller 2 is compressed from the configuration illustrated in FIG. 10, to that shown in FIG. 11, with beveled edges 4 in mating relationship. After hair 21 is so positioned, a securing member having the configuration of a comb base 8 is then positioned in cooperation with tension roller 2, with comb teeth 10 and comb picks 11 placed beneath the bottom surface of tension roller 2 against scalp 22 in order to secure tension roller 2 in the hair. It will be appreciated that comb base 8 includes a comb rib 9, and comb teeth 10 and comb picks 11, formed on comb rib 9, and made of sufficient size and strength to securely locate tension roller 2 and comb base 8 in a selected position in the hair. When comb base 8 and tension roller 2 are so positioned, the pair of tension cords 12 attached to comb rib 9 by means of comb base connectors 15 are stretched over the hair 21 and body 3 of tension roller 2, and fastened by means of tension hooks 13 in selected ones of apertures 6, to create a selected amount of tension on the shafts of hair 21 and on body 3 of tension roller 2. This bias placed on tension roller 2 by winding the hair 21 on body 3 and securing of tension cords 12 maintains beveled edges 4 in closed configuration as illustrated in FIGS. 3 and 11 of the drawing, and places a selected amount of tension on the shafts of hair 21. The hair so tensioned is now ready to be treated with a hair relaxing solution as desired.

Figure 6:
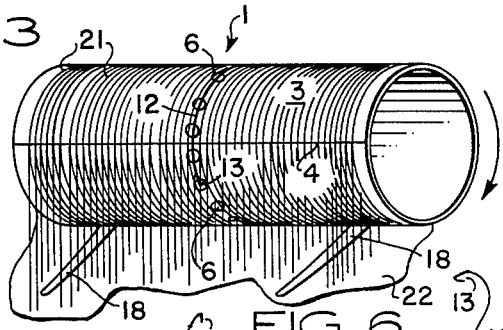
FIG. 6 is a front perspective view of the tension roller illustrated in FIG. 2 in combination with a roller base for securing tension on a segment of hair.
Figure 4:
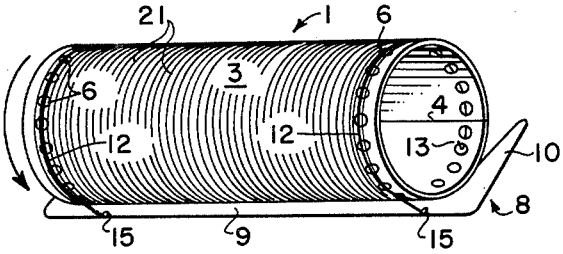
FIG. 4 is a rear perspective view of the tension roller and cooperating comb base combination illustrated in FIG. 3.
Figure 5:
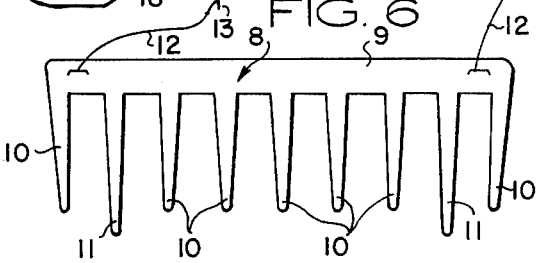
FIG. 5 is a top elevation of the comb base illustrated in FIGS. 3 and 4 of the drawing.
Figure 7:
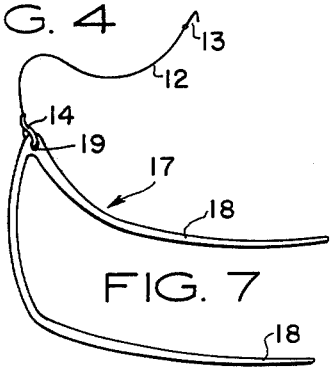
FIG. 7 is a perspective view of the roller base illustrated in FIG. 6.
Figure 8:
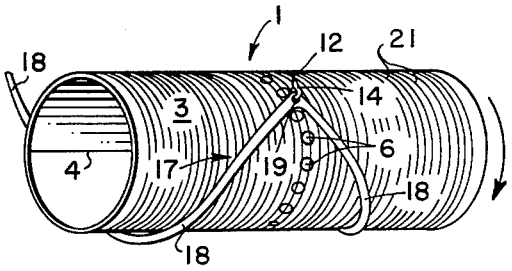
FIG. 8 is a rear perspective view of the roller base and cooperating tension roller combination illustrated in FIG. 6.
Figure 9:
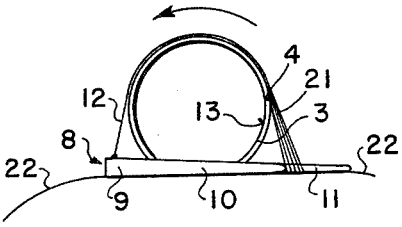
FIG. 9 is a side elevation of the comb base and tension roller combination illustrated in FIGS. 3 and 4 of the drawing.

Referring now to FIGS. 6–8 of the drawing, in an alternative preferred embodiment of the invention, hair 21 is wound on body 3 of the tension roller 2 illustrated in FIG. 2 in the manner heretofore described, and a roller base 17 of slightly different design than comb base 8 is positioned beneath tension roller 2 in order to secure tension roller 2 in the hair. Referring specifically to FIGS. 7 and 8 of the drawing, roller base legs 18 of roller base 17 are slipped beneath body 3 of tension roller 2 and against scalp 22 after hair 21 is wound thereon, and a single tension cord 12, positioned on roller base 17 by means of a tension cord connector 14 fixed to roller base eye 19, is stretched over hair 21 and body 3 of tension roller 2, and secured to one of apertures 6 located in the center section of body 3. Tension roller 2 is compressed as heretofore described, and a selected amount of tension is applied on the shafts of coiled hair 21.

It will be appreciated that the hair treatment device of this invention can be utilized with a variety of tension rollers of a general design illustrated in the drawing and heretofore described. The device can be quickly and easily uitilized to place tension on hair tufts and tresses by the simple expedient of winding the hair on the roller and inserting the fastening means, whether it be a comb base or a roller base, beneath the tension roller and adjacent the hair so rolled, and quickly applying additional tension to the hair shafts by means of the tension cord or cords. Application of well known wave relaxing solutions to the hair so tensioned results in a relaxed natural wave in the hair and may be used to change the wave pattern in order to present a more manageable proportion to the hair.

Figure 13:
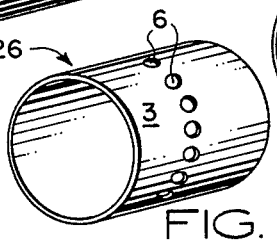
FIG. 13 is a perspective view of an alternative tension roller for use in setting hair.
Figure 12:
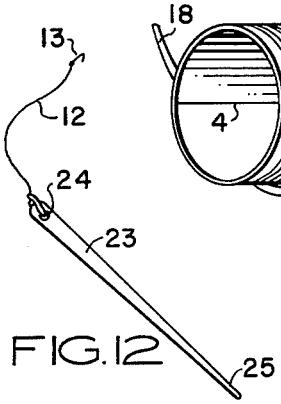
FIG. 12 is a perspective view of a pin base for securing tension on a segment of hair.

In yet another preferred embodiment of the invention, and referring now to FIG. 12 of the drawing, a pin base 23, fitted with a pin eye 24 on the end opposite pin base tip 25 is provided for use with either the tension roller 2 illustrated in FIG. 2, or the continuous shell roller 26 illustrated in FIG. 13. Typically, pin base 23 can be used to secure the tension roller 2 illustrated in FIG. 2 in position on scalp 22 in the same manner and for the same purpose as roller base 17. Alternatively, pin base 23 can be used in cooperation with the shorter continuous shell roller 26 to set the hair in a permanent wave or other curl configuration.

Referring again to the drawing, particular attention is called to the embodiment illustrated in FIGS. 10 and 11 wherein beveled edges 4 are provided to present a substantially round body 3 of tension roller 2 in order that hair 21 may lie on body 3 as evenly as possible. It will be appreciated by those skilled in the art that while a primary objective of using conventional hair rollers to apply hair treatment solutions is to present a large surface area of hair for exposure to the chemicals, the hair treatment device of this invention goes far beyond this concept. As described above, and referring again to the drawing, the winding of a segment of hair 21 on body 3 of tension roller 2 compresses body 3 and results in a first tension being applied to the hair shafts of hair 21. The positioning of a fastening means such as a comb base 8, a pin base 23, or a roller base 17 in cooperation with the tension roller 2 and fastening the tension cords 12 in proper position produces a second tension on the hair shafts of hair 21 and also serves to stabilize tension roller 2 and to supplement the first tension on the hair shafts of hair 21. This two-fold application of tension has been found to greatly enhance the subsequent successful chemical treatment of the hair.

Having described my invention with the particularity set forth above, what is claimed is.

1. A hair treatment device comprising:

(a) a hollow, split tension roller essentially cylindrical in shape with the split edges of said roller bevelled and normally spaced apart, said roller having a plurality of apertures in the outer surface thereof;

(b) securing means positioned between said tension roller and the scalp of a user after hair is rolled on said tension roller and said split edges of said roller abut; and (c) first bias means carried by said securing means and cooperating with one of said apertures for applying tension to said hair.

2. The hair treatment device of claim 1 further comprising internal bias means in cooperation with said tension roller to exert internal pressure on said tension roller.

3. The hair treatment device of claim 1 wherein said apertures are disposed near the center and around the circumference of said tension roller.

4. The hair treatment device of claim 1 wherein said apertures are disposed near the ends and around the circumference of said tension roller.

5. The hair treatment device of claim 3 wherein said securing means is a roller base characterized by a pair of arcuate legs converging at a common point and provided with an eye at said point, and said first bias means is an elastic cord having a hook on the free end for mating with said apertures.

6. The hair treatment device of claim 3 wherein said securing means is a pin base characterized by a thin, tapering member having an eye at the large end, and said first bias means is an elastic cord having a hook on the free end for mating with said apertures.

7. The hair treatment device of claim 4 wherein said securing means is a comb base characterized by a generally flat comb fitted with a plurality of relatively short teeth, and said first bias means is a pair of elastic cords, each having a hook on the free end for mating with said apertures.

* * * * *